US007114447B2

(12) United States Patent
Xifra I Boada et al.

(10) Patent No.: US 7,114,447 B2
(45) Date of Patent: Oct. 3, 2006

(54) FLEXOGRAPHIC PRINTER WITH ENCLOSURES AT A REGULATED TEMPERATURE AND VAPOR EXTRACTION

(75) Inventors: Manuel Xifra I Boada, Girona (ES); Joaquim Julia I Ferrer, Girona (ES); Jordi Sahun Peres, Girona (ES); Jordi Puig I Vila, Girona (ES)

(73) Assignee: COMEXI, S.A., Girona (ES)

( * ) Notice: Subject to any disclaimer, the term of this patent is extended or adjusted under 35 U.S.C. 154(b) by 0 days.

(21) Appl. No.: 10/508,345

(22) PCT Filed: Mar. 20, 2002

(86) PCT No.: PCT/ES02/00135

§ 371 (c)(1),
(2), (4) Date: May 2, 2005

(87) PCT Pub. No.: WO03/080341

PCT Pub. Date: Oct. 2, 2003

(65) Prior Publication Data

US 2005/0211124 A1 Sep. 29, 2005

(51) Int. Cl.
*B41F 23/04* (2006.01)

(52) U.S. Cl. ..... 101/487; 101/153; 101/178; 101/216; 454/49

(58) Field of Classification Search ..... 101/153, 101/487, 216
See application file for complete search history.

(56) References Cited

U.S. PATENT DOCUMENTS 2,256,515 A * 9/1941 Brueshaber ..... 101/157
4,502,228 A 3/1985 Helbig et al.
4,833,794 A * 5/1989 Stibbe et al. ..... 34/643
5,010,813 A * 4/1991 Buffo ..... 101/178
5,048,418 A 9/1991 Hars et al.
5,134,788 A 8/1992 Stibbe et al.
5,503,069 A 4/1996 Blim
5,507,229 A 4/1996 Rogge et al.
5,595,115 A * 1/1997 Rau et al. ..... 101/142
5,603,261 A * 2/1997 Buenz ..... 101/216
6,766,743 B1 * 7/2004 Hayashi et al. ..... 101/487

FOREIGN PATENT DOCUMENTS

DE 39 38 405 C1 5/1991
ES 2 112 111 3/1998
WO 90/03855 * 4/1990

OTHER PUBLICATIONS

International Search Report for PCT International Application PCT/ES02/00135 mailed Jul. 22, 2002.

* cited by examiner

*Primary Examiner*—Daniel J. Colilla
*Assistant Examiner*—Marissa Ferguson-Samreth
(74) *Attorney, Agent, or Firm*—RatnerPrestia

(57) ABSTRACT

The invention relates to a flexographic printer comprising: inner dividing means which, together with a surround casing, define first, second and third enclosures; and fluid circulation means which are used for the circulation of at least one fluid at a regulated temperature. The aforementioned enclosures are sufficiently closed off and insulated from one another and the fluid is circulated at a sufficient flow rate, such that the solvent vapour concentration in the atmosphere, originating from the ink, is below a lower pre-fixed explosion limit in at least the second and third enclosures which house means of actuating the rotation and movement of the cylinders and electric and/or electronic devices and/or elements associated therewith.

22 Claims, 4 Drawing Sheets

FLEXOGRAPHIC PRINTER WITH ENCLOSURES AT A REGULATED TEMPERATURE AND VAPOR EXTRACTION

This application is a U.S. National Phase Application of PCT International Application PCT/ES02/00135, filed Mar. 20, 2002.

TECHNICAL FIELD

This invention concerns a flexographic printer with temperature-regulated sections and vapour extraction, and more specifically, a flexographic printer including a casing fitted with interior means of division that form suitably insulated sections containing various printer components, with a fluid at a regulated temperature circulating through these sections.

BACKGROUND

A flexographic printing machine typically consists of support structures on which one or more back-pressure cylinders are mounted, which support a moving continuous band of material to be printed, and one or more flexographic printing heads, each of which consists of a cliché-holder cylinder that can make contact with the cited band to be printed and an ink-well or inking unit, which includes at least one ink cylinder to supply ink to the cliché-holder cylinder. Each print head can be associated with its respective back-pressure cylinder having a relatively small diameter or all the print heads can be located around a single, central, large diameter back-pressure cylinder. The incorporation of several print heads is employed to successively print the continuous band in different colours. In this way, the first print head deposits ink of one colour on the band to be printed and the successive heads superimpose inks of other colours. To prevent colour mixing it is necessary to dry the previous colour ink before applying another. Drying the ink involves the evaporation of the pigment diluent it contains and this is usually accomplished using drying boxes located between the print heads, which include the means of blowing hot air onto the printed band, together with the option of air suction to extract the air contaminated with the solvent vapour from the area of influence of the drying box.

It is also usual to protect this type of printing machine with casing or fairings that basically meet certain safety functions, preventing operator access to dangerous components and health functions by reducing the level of noise reaching the operators and also improving the machine's visual aspect. In order to comply with the cited soundproofing function, the fairings tend towards greater levels of insulation and sealing, with the acoustic insulation also doubling as heat insulation.

Unfortunately, this combination of insulation and sealing also involves the following two disadvantages:

- The heating of all the machine's components because of the heated air blown inside the casing by the drying boxes, and
- A concentration of solvent vapour inside the casing, specifically the lower section since typical solvent vapour is denser than air.

The heating problem generally affects all the printer components and mechanisms, but very specifically the large-diameter central back-pressure cylinder and its support structures, in those machines fitted with them. This central back-pressure cylinder must be manufactured with certain dimensional tolerances, especially cylindricity, which are very close and must be maintained throughout operation periods. Because the drying boxes produce the hot air impulsion directly over localised areas of the back-pressure cylinder, cylinder expansion, especially when operating slowly, can produce deformation that exceed the permitted tolerance. The expansion deformation suffered by the support structures also negatively affects the machine's operation.

There are various well-known devices for cooling or maintaining the back-pressure cylinder at a constant temperature by means of circulating water. One such device consists of fitting the cylinder with a double steel wall that provides an intermediate space through which the cooling water is able to circulate.

U.S. Pat. No. 5,048,418 describes a flexographic printing machine with support structures or beds fitted with the means to regulate the temperature. These means consist of one or more closed channels for the circulation of a cooling or temperature-regulating fluid. The channels follow spiral paths to cover at least the support structure zones where the back-pressure cylinder is mounted.

However, both the cited means for cooling the cylinder and the means of cooling the support structure or bed are designed for very specific areas of the machine, but do not provide any overall temperature regulation inside the casing.

With respect to the problem of solvent vapour concentration, the previously described means of extraction associated with the drying boxes are known, but they are not sufficient to prevent an accumulation of solvent vapour of the lower section inside the insulated casing. The vapour produced by commonly used solvents is highly inflammable and accumulations inside the casing normally exceed a determined lower explosion limit, which means that a high-level of intrinsic protection must be employed in the printer's electrical devices and components, the measurements of which are strictly regulated by industrial codes in most countries. The implementation of the cited means of high-level protection and safety involves high economic costs of the components and, in addition, does not reduce the concentration of the explosive vapours inside the casing.

The objective of this invention is to produce a flexographic printer with a surrounding casing and interior dividing means in order to produce at least two sections, fitted with the means to regulate the temperature and the vapour concentration levels inside the casing that are capable of providing a suitable operating temperature for the component parts and, at least in one of the described section, the one housing all the drive means and electrical or electronic devices, maintain a vapour concentration level below a preset lower explosion limit, which will make the application of the high-level means of protection unnecessary for the described electrical devices.

Another objective of this invention is to provide a flexographic printer with the additional advantage of protecting those elements associated the drives from dirt and to permit access for ease of cleaning in those areas exposed to possible impregnation by ink.

DESCRIPTION OF THE INVENTION

The previous objective is achieved in accordance with this invention, by producing a flexographic printer of the type consisting of a frame on which are mounted at least one rotating back-pressure cylinder and at least one print head, which consists of a cliché-holder cylinder that can make contact with a band to be printed supported on the cited back-pressure cylinder and an inking unit, consisting of at least one inking cylinder that supplies ink to the cited cliché-holder from a tank. The rotation of the various is provided by suitable drive means, generally electric motors. The components of the flexographic print head can be moved closer to or farther away from the cited back-pressure cylinder, so that the machine is also fitted with the means of driving this movement the said components, which is also usually provided by electric motors. The printer of this invention is also the type that includes the means for drying or curing the film of ink deposited on the band to be printed and a surrounding casing. The flexographic printer of this invention is characterised in that the cited surrounding casing, in combination with interior dividing means, delimits at least two sections, through which at least one fluid circulates that is introduced at a temperature regulated by a means of impulsion and is sucked out by means of extraction, with the cited sections being sufficiently closed to provide a specific atmosphere inside at an efficient controlled temperature.

In addition, in one of the said sections, those printer organs that produce a continuous degree of solvent vapour generation are concentrated, such as the inking cylinders, ink tanks and other inker components etc, while those printer devices that contain electrical and/or electronic elements, such as drive motors, power supplies and control etc, are concentrated in the other section, of which there is at least one. Both sections are sufficiently insulated from each other so that the degree of solvent vapour leakage from the first to the second is secondary, with the circulating volume of the said fluid being sufficient for the interior atmosphere of at least the second section that houses the electrical and/or electronic components has a vapour concentration from the ink that is below a lower preset explosion limit. This lower explosion limit is established in accordance with strict regulations in most countries or, in the absence of this, it may be calculated.

The fluid circulating through the cited sections should be a gas; more specifically it should be air.

According to a preferred exemplary embodiment of the invention, the cited back-pressure cylinders, cliché-holder and inker are arranged between the first and second support structures which make up the cited frame, while the cited means of rotation drive and movement are arranged on the outer sides of both the first and second support structures. The cited means of division are arranged in relation to the first and second support structures in order to create three of the said separated sections in co-operation with the surrounding casing: a first section between the first and second support structures, where the cylinders and cited means of drying are housed; and the second and third sections in exterior zones of the first and second support structures, where the means of rotation drive and movement are housed. However, the invention also contemplates the possibility of arranging the means of division in relation to only one of the support structures so that only two sections are formed: a first section between the first and second support structures, where the cylinders and means of drying are housed; and a second section in an exterior zone of the first support structure, where the means of rotation drive and movement are housed. The essential part, in both cases, is that the first section houses the all the elements that are in direct contact with the ink and, therefore, where continuous evaporation of the solvent takes place, is sufficiently isolated from the second and/or third section where all the means of drive are concentrated (in general, the electric motors) and electrical and/or electronic components associated with the said means of drive, such as connectors, switches, relays and fuses etc. Thus, in the first section, the risk of explosion is practically eliminated thanks to the mentioned air circulation, which guarantees that the said solvent vapour concentration is maintained below the preset lower explosion limit, which will also avoid the need to install costly, high-level protection devices for the electrical elements whish would otherwise be necessary.

In addition to the actual motors and as is usual in this type of machine, the means of drive include also includes the means of guidance and mechanical transmission, which here, are arranged in the said second and third sections, and therefore safeguarded from possible ink impregnations, with the said first section, together with the components it contains, being easily accessible for cleaning.

The mentioned means of air flow impulsion consists of at least one fan connected to a conduit for the entry of the fluid, which is fitted with branches with various impulsion mouths distributed inside the said first, second and third sections. The mentioned means of extraction consists of at least one fan connected to a fluid exit conduit fitted with branches with various suction connections that are similarly distributed inside the first, second and third sections. Because it is normal to employ a solvent for the ink, the vapour of which is denser than air, at least one of the said suction connections is located in the lower zones of the first section, which contains the cylinders and means of drying, in order to extract the solvent vapour coming from the ink drying and evaporation, together with the exiting fluid or air.

Just as was described earlier, the flexographic print head or heads can be moved closer to or farther away from the back-pressure cylinder, of which there is at least one. Thus, the cited components are mounted in a movable fashion on suitable guides fixed on the support structures. Since the cliché-holder cylinders are arranged in the first section between the support structures and their respective means of rotation drive and movement are located in the second and third sections arranged on the other sides of the support structures, these support structures contain apertures by which part of the means of drive for the flexographic print head components are moved.

According to a construction example of this invention, the means of division consist of curtains of fluid, in other words, air, driven from impulsion mouths connected to branches of the cited air entry conduit and located in relation to the said first and second support structures in the upper section inside the casing. These curtains are sucked from several of the said suction connections, which are connected to branches of the exit conduit and located in a lower zone of the casing. According to another construction example, the support structures from closed panels in which the only apertures are those previously described above, by which the flexographic print head components are moved, and the means of division consist of elastic and/or flexible and/or sliding elements that cover the cited apertures. It must be pointed out here that both construction examples are fully compatible and can exist in the same printer design. It is not necessary for the casing and the means of division to provide a complete seal for the sections, but that they are sufficiently closed in order to guarantee their intended purposes.

Conventional drying boxes may be employed for the means of drying or cutting, which are connected here by one side to specific means of impulsion, which blow previously heated air over the printed band and by the other side to a branch of the cited exit conduit connected to the said means of general casing suction in order to suck the air and solvent vapour from the ink.

The air from the drying box is heated by some means of heating, such as a fuel burner or electric element. The air that enters the sections at a regulated temperature via the entry conduit is heated/cooled by means of, for example, a water/air heat exchanger located outside the sections.

As an advantage, the operation of the said heat exchanger unit and/or blower fan and/or extraction fan for regulating the entry flow rate and fluid flow rate and exit solvent vapour are controlled by certain electronic means of control in function of a signal received from at least one temperature sensor located inside the surrounding casing. The temperature regulation control is further completed by means of the said temperature sensors installed at various points in the said first, second and third sections, together with various means of register driven by their respective means of drive in various branches of the said entry and/or exit conduits. In this case, the cited electronic means also control the operation of the cited means of drive for the means of register in order to regulate the flow rate and temperature of the entry fluid and fluid flow rate and exit solvent vapour in different zones of the various sections in function of the signals received from the said various temperature sensors.

The printer configuration of this invention can consist of either several flexographic heads associated with a single common back-pressure cylinder, or several flexographic heads, each associated with its own back-pressure cylinder. When there is only one common back-pressure cylinder, this may be optionally fitted with any of the known temperature regulation devices, such as the water cooling device described above.

BRIEF EXPLANATION OF THE DRAWINGS

The characteristics and advantages of this invention are made more evident by the following detailed description of a preferred construction example with reference to the attached drawings, in which.

DETAILED DESCRIPTION OF THE INVENTION

Figure 2:
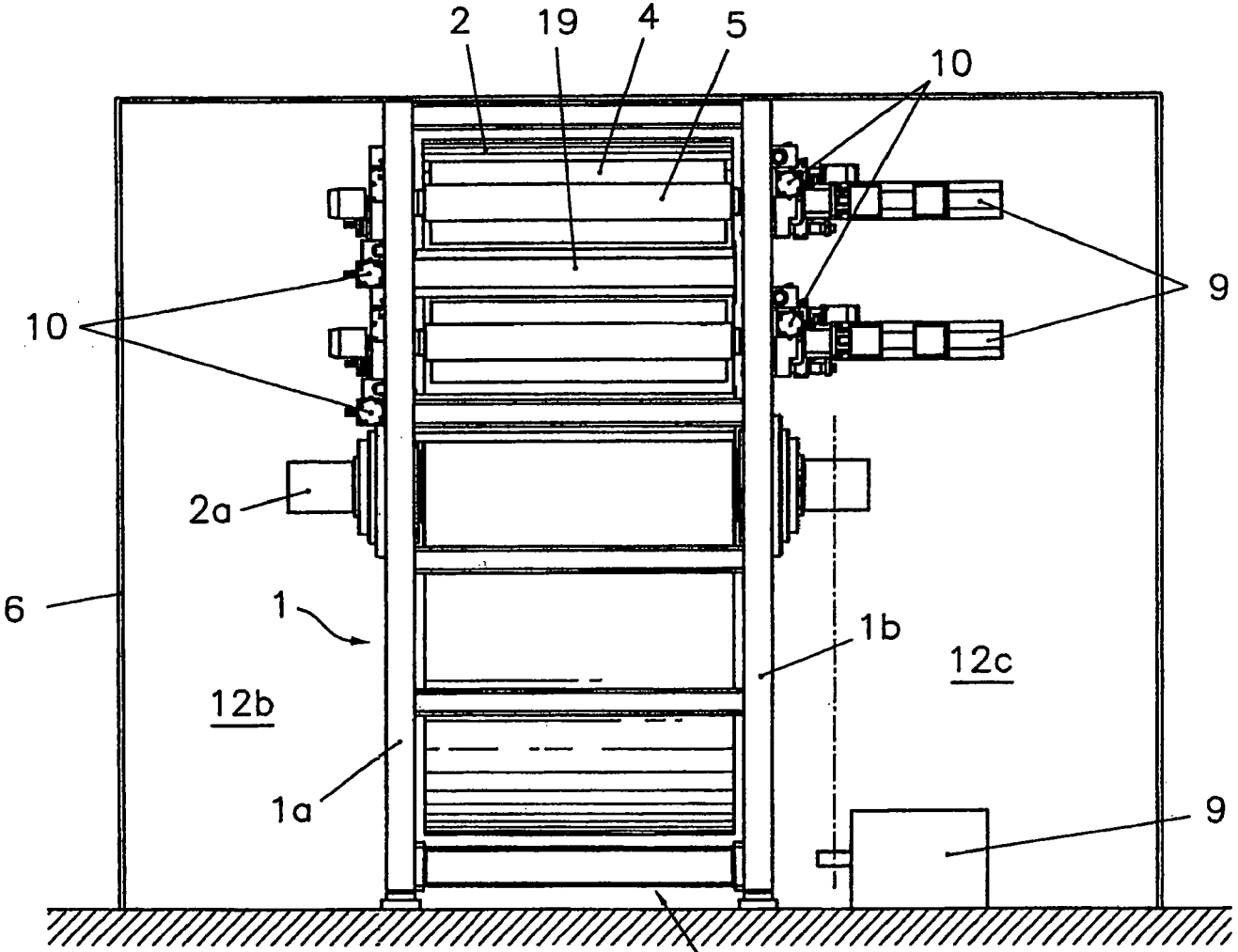
FIG. 2 is a simplified front elevation of the flexographic printer of this invention, in which the separated sections are shown that house the cylinders and means of drive respectively and in which the entry and exit conduits have been omitted for greater clarity of the drawing.

First referring to FIG. 2, this shows a example of the execution of the flexographic printer, which consists of a frame that defines the two supports structures 1*a* and 1*b*, between which is a single, large diameter, back-pressure cylinder 2 that is mounted rotationally on the said frame 1 and fitted with an exterior support surface for a band to be printed (not shown). This single, large diameter cylinder can be cooled by means of a known water-cooled device. Several flexographic printing heads are arranged in relation to the cited single back-pressure cylinder 2, with each print head consisting of a cliché-holder cylinder 4 that can make contact with the cited band to be printed on the said back-pressure cylinder 2 and an inker unit, which is made up of an inking cylinder 5 for supplying ink from tank to the said cliché-holder cylinder 4. Although in the shown construction example, there is a single back-pressure cylinder 2, this invention could also apply to a printer (not shown) fitted with multiple, small diameter, back-pressure cylinders, each one being associated with a print head. In any case, the components of the said flexographic print head can be moved closer to or father away from the back-pressure cylinder. Each of cylinders 2, 4 and 5 are coupled to the means of rotation drive 9 and the flexographic print head components are also connected to the means of movement drive. The printer include means for drying or curing the film of ink deposited on the band to be printed and surrounding casing 6.

Figure 3:
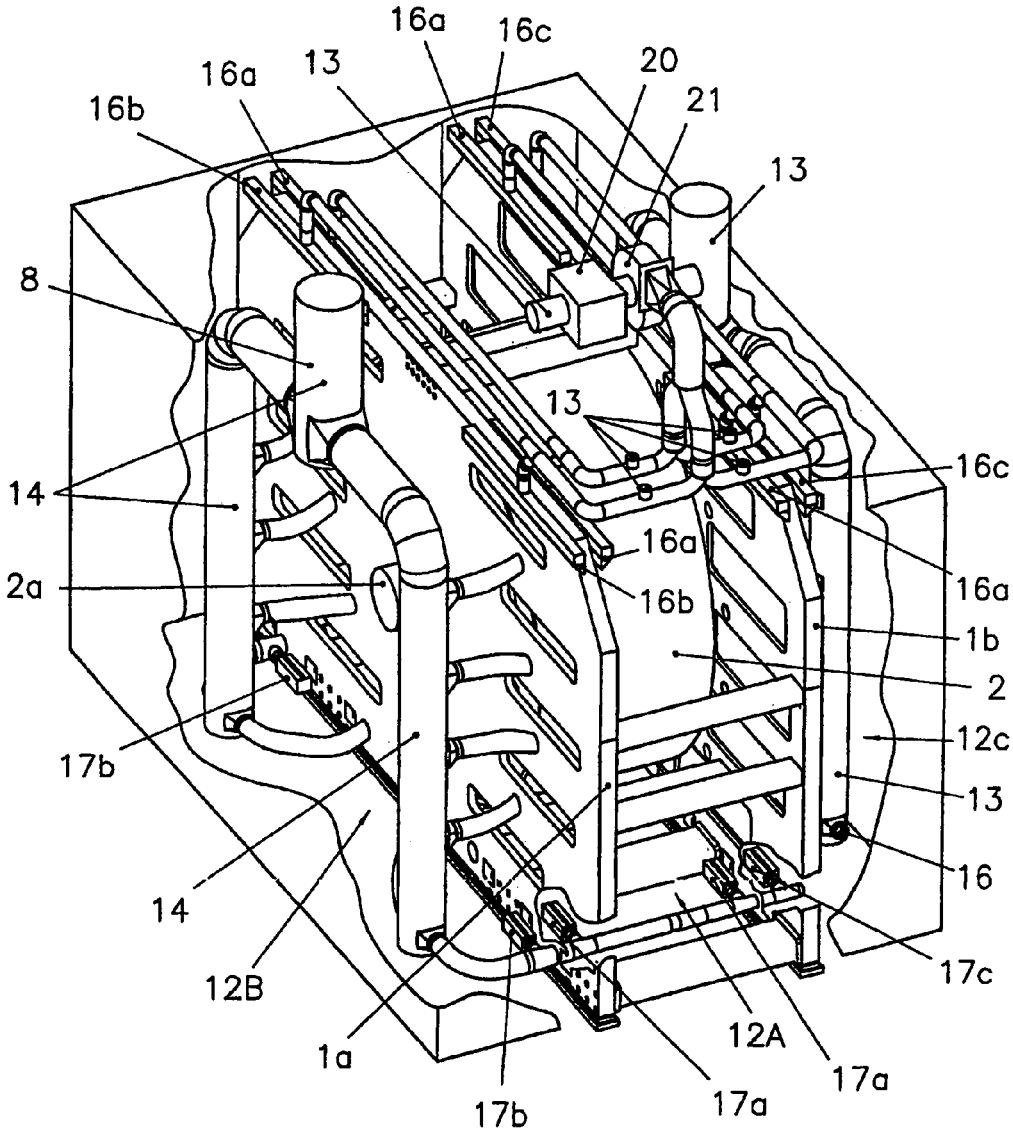
FIG. 3 is a perspective view, with certain parts of the flexographic printer of this invention partially sectioned, in which the separated sections and the entry and exit fluid conduits can be seen and in which the print heads have been omitted from greater clarity of the drawing.

The essential characteristic this invention is that the cited surrounding casing 6, in combination with interior dividing means 11, delimits at least two sections and, in general, three sections, designated here as the first, second and third sections 12*a*, 12*b* and 12*c* through which at least one fluid circulates that is introduced at a temperature regulated by a means of impulsion 21 and is sucked out by means of extraction 8 by suction (FIG. 3). The mentioned first, second and third sections 12*a*, 12*b* and 12*c* are sufficiently closed and insulated from each other and the cited fluid circulation is carried out at a flow rate that is sufficient to provide an atmosphere with a solvent vapour concentration from the ink below a lower preset explosion limit in at least the second section 12*b* and, in general, in the second and third sections 12*b* and 12*c*, which house certain electrical and/or electronic elements and/or devices associated with the said means of drive (9, 10). The fluid circulation at regulated temperature also maintains most of the various printer components at a suitable operating temperature.

Preferably, the cited fluid is a gas and more preferably is air, although other gases, such as nitrogen, may also be employed.

As an advantage, the cited back-pressure cylinders, cliché-holder and inker 2, 4 and 5 and the said means of drying are installed between certain respective internal facing faces of the cited first and second support structures 1*a* and 1*b* of the said frame 1, while the cited means of rotation drive 9 and 10 are arranged on respective external faces, opposite the cited facing faces of both the first and second support structures 1*a* and 1*b*.

Just as will be explained below, with reference to FIGS. 3 and 4, in relation to the first and second support structures 1*a* and 1*b*, the mentioned means of division 11 are arranged to create three separated sections: a first section 12*a* between the internal facing faces of the first and second support structures 1*a* and 1*b*, which contain the cylinders 2, 4 and 5, together with the means of drying; and the second and third sections 12*b* and 12*c* in zones adjacent to the said external faces of the first and second support structures 1*a* and 1*b* where the means of rotation drive 9 and movement 9 and 10 are housed. In the example shown in FIG. 2, the print heads are located above the back-pressure cylinder rotation 2 of shaft 2*a*, with the means of rotation drive in the third section 12*c* and the means of movement drive 10 in the second section 12*b*. However, there may be print heads on both sides of shaft 2*a* and the means of rotation drive 9 and 10 may be inverted in sections 12*b* and 12*c*, alternatively distributed in both the second and third sections 12*b* and 12*c* or all concentrated in the same section, for example, in the second section 12*b*. In this latter case, the means of division 11 associated with the second support structure 1*b* may be omitted so that there are only the first and second sections 12*a* and 12*b*.

The purpose of the separated sections 12*a*, 12*b* and 12*c* is to isolate zone 12*a* in which the cylinders are located and consequently where the ink is handled, of zones 12*b* and 12*c* where the cylinder drive means are located, including the electric motors, and the electrical and/or electronic components and devices associated with the said drive means. In addition, this separation also provide increased guarantees that in the said zone, which houses the electrical and/or electronic components and devices, in other words, the second and/or third sections 12*b* and 12*c*, the cited solvent vapour concentration is below the said preset lower explosion limit. This is achieved by means of the cited air circulation at the regulated temperature, which also guarantees a suitable operational temperature in all sections 12*a*, 12*b* and 12*c*.

As an additional advantage, it must be mentioned that the drive means 9 and 10 include, in addition to the motors and power supply and control devices, the means for guidance and mechanical transmission which, in the printer of this invention, are also installed in the said second and third sections 12*b* and 12*c*. In this way, all the elements and mechanisms associated with the drive means 9 and 10 are safeguarded from possible impregnation by ink, with the first section 12*a* and the elements it contains being easily accessible for cleaning.

Figure 1A:
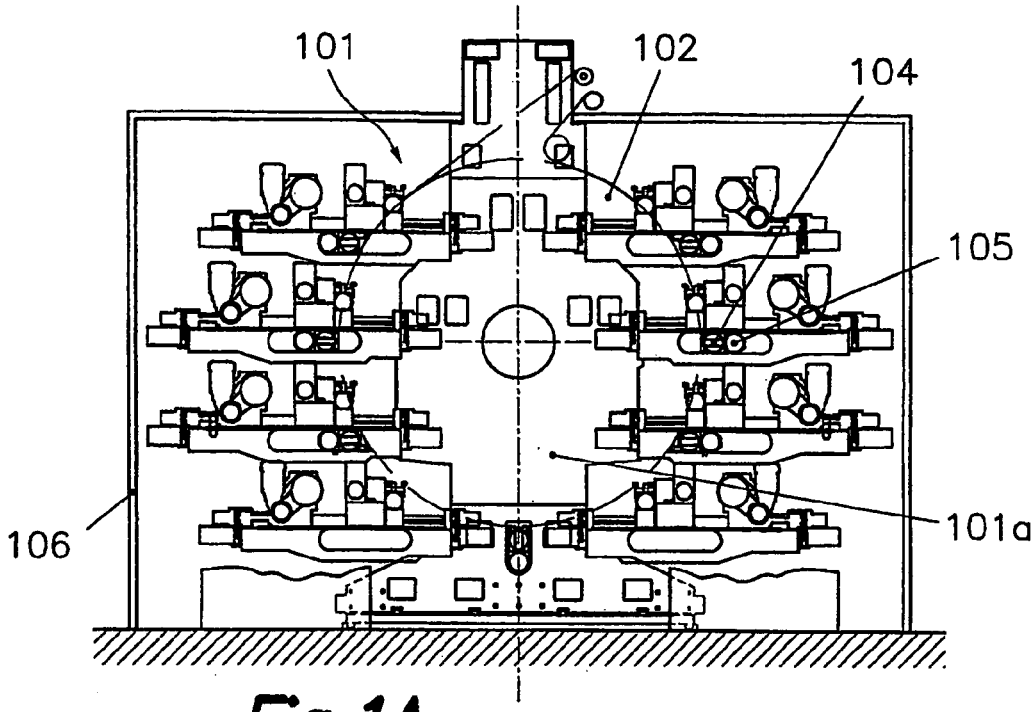
Fig. 1A Prior art
FIGS. 1A and 1B are simplified elevation and plan views respectively of a flexographic printer in the prior art.
Figure 1B:
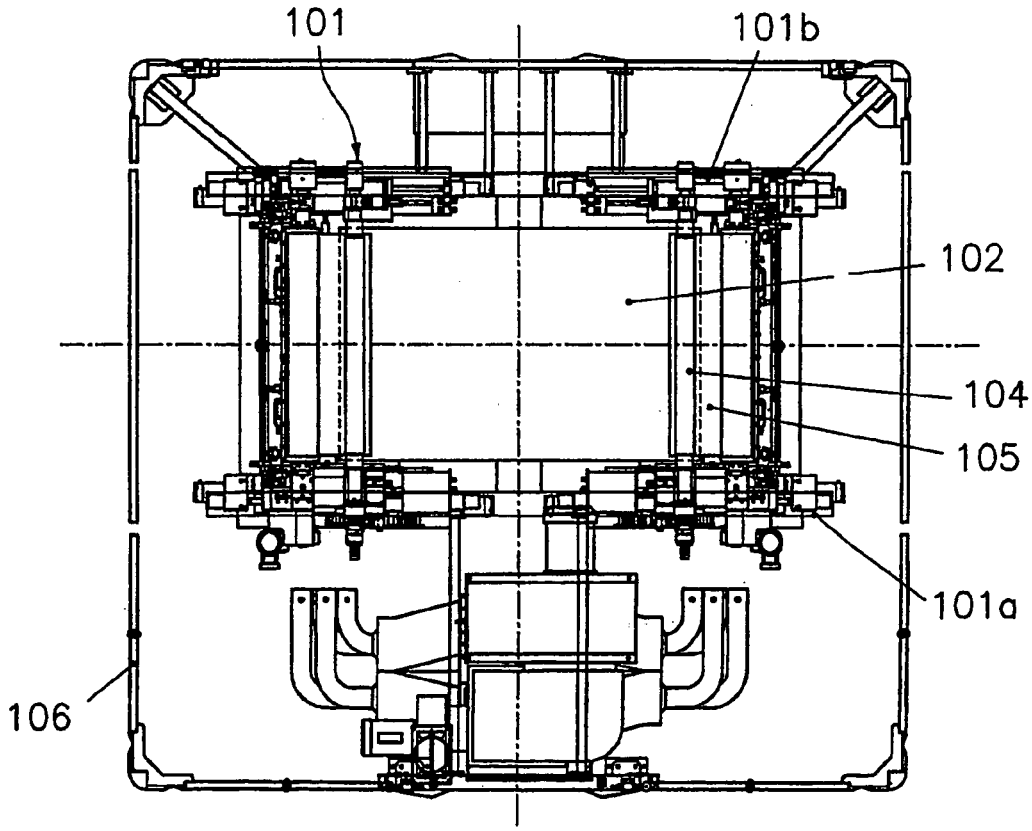
Fig. 1B Prior art

If we briefly examine FIGS. 1A and 1B, which show a prior art printer, in which a frame 101 can be seen, consisting of support structures 101*a* and 101*b*, between which the back-pressure cylinder 102 and print unit cylinders 104, 105, together with their drive means, are mounted. The assembly is closed by the surrounding casing 106. However, there is no compartmentalisation inside the casing 106, which defines different sections for the components that are in contact with the ink and for the electrical components. In this prior art printer, the means of cooling are provided for cooling certain parts of the support structures 101*a*, 101*b* and form the frame 101 by water circulation. However, the means to regulate the overall temperature inside the casing 106 are not provided.

Just as shown in FIG. 3, the mentioned means for circulating air consist of a fan 21, connected to an air entry conduit 13, which is fitted with branches with various impulsion mouths 16 distributed inside the said first, second and third sections 12*a*, 12*b* and 12*c*. The said means of extraction consists of a fan 8, connected to a air exit conduit 14, which is fitted with branches with various suction connections 17 distributed inside the first, second and third sections 12*a*, 12*b* and 12*c*. In order to extract solvent vapour from the ink, together with the exit air, at least one of the said suction connections 17*a* is arranged in a lower zone of the first section 12*a*.

According to the preferred construction example shown in FIG. 3, the said means of division 11 consists of air curtains at a regulated temperature blown from impulsion mouths 16*a*, 16*b* and 16*c*, which are connected to branches of the entry conduit 13 and located next to both sides of the said first and second support structures 1*a* and 1*b*, in the upper part of the inside of casing 6. Several suction connections 17*a*, 17*b* and 17*c* connected to the exit conduit branches 14 and located next to both sides of the first and second support structures 1*a* and 1*b* in a lower zone of casing 6 suck the cited air curtains. Thus, any solvent vapour attempting to escape from the first section 12*a*, will be dragged by the air curtain turbulence and sucked out by the suction mouths 17*a*, 17*b* and 17*c*, together with the circulation air towards the exit conduit 14. This air mixed with solvent vapour may be processed in order to clean it and even to recover solvent before being released into the atmosphere.

Figure 4:
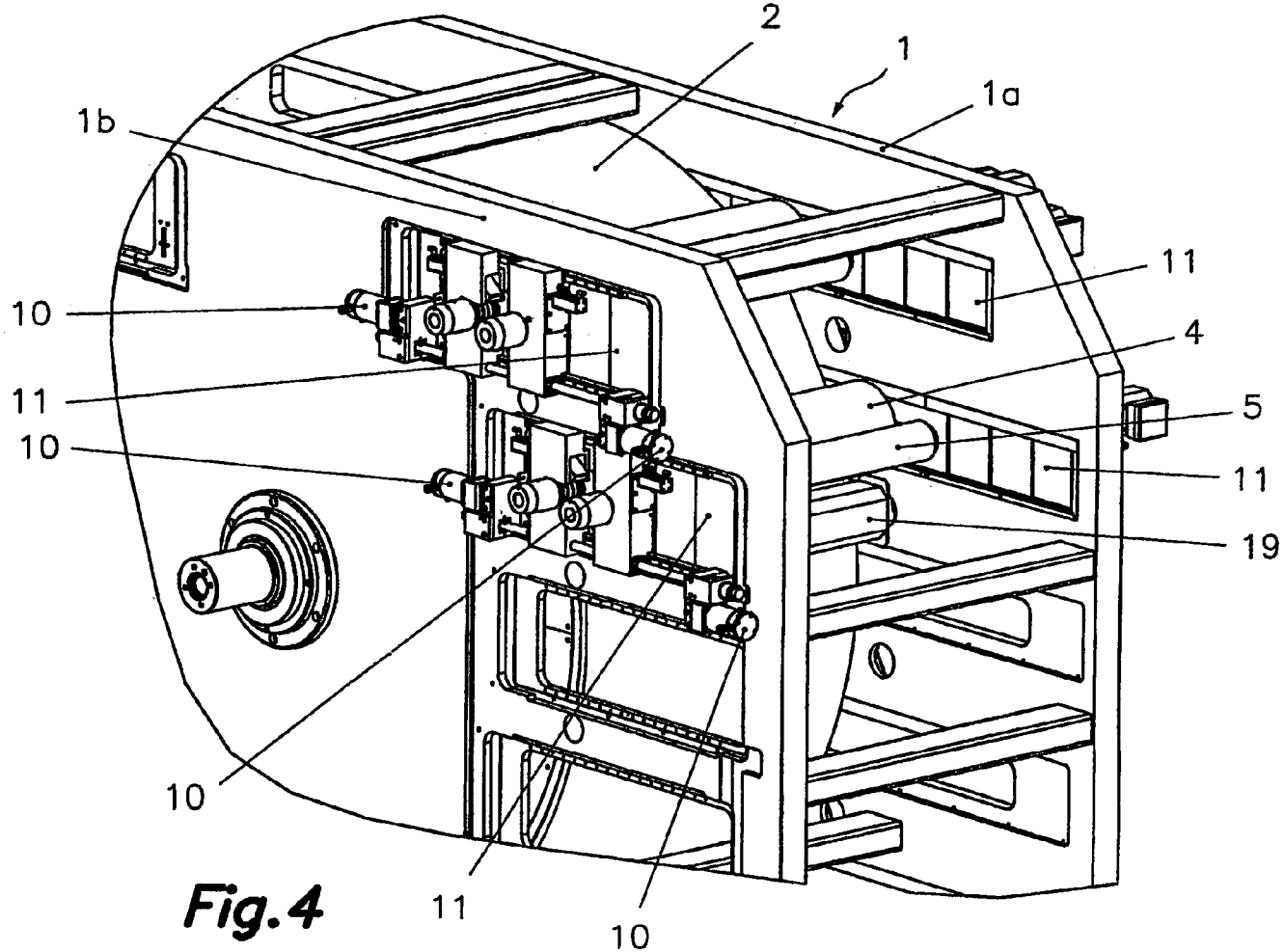
FIG. 4 is a partial enlarged perspective view that shows certain details of the printer of this invention with relation to the support structures that form the frame.

Now, in relation to FIG. 4, this shows another construction example, in which the said means of division 11 consist of, in cooperation with the actual support structures 1*a* and 1*b*, which have a configuration in the form of a panel, with apertures by which the flexographic print head components move, sliding means 11 to cover these apertures as the said components move. These means of division may be elastic and/or flexible elements, such as bellows, with the same efficiency. A more efficient compartmentalisation may be achieved by jointly employing the air curtains shown in FIG. 3 and the elastic or flexible sliding elements 11, shown in FIG. 4.

The mentioned means of drying or curing consist of conventional drying boxes 19, which are connected by one side to the means of air impulsion directed towards the printed band and by the other side to at least one branch of the cited exit conduit 14 connected to the said means of suction 8 to suck the said fluid and solvent vapour produced by the ink. The air blown by the said means of impulsion, which consist of an impulsion fan coupled to a conduit connected to the entrance to the drying box 19, is previously heated, for example, by means of a fuel heater or an electric heating element.

It should be noted that the cited means of air impulsion and heating for the drying boxes 19 are independent of the means of introducing 21 the air at regulated temperature which circulates through the sections. On the other hand, the means of circulation 8 are common. This is because the circulating air entry may require heating, but it might also require cooling in function of the general operating conditions. Therefore, the introduced air at the regulated temperature is heated/cooled by means of suitable means, such as a water-air heat exchanger 20 located outside the sections.

As an advantage, at least one temperature sensor is installed inside the surrounding casing 6, together with the electronic means to control the operation of the said heat exchanger 20, the blower fan 21 and the extraction fan 8 in order to regulate the flow rate and temperature of the entry fluid and the flow rate of the exit fluid and solvent vapour in function of a signal received from the said temperature sensor. According to a more complete variant, the printer of this invention includes several of the said temperature sensors installed at various points of the said first, second and third sections 12*a*, 12*b* and 12*c*, together with the means of inspection in various branches of the said entry 13 and exit 14 conduits, the means of inspection of which are driven by their respective drive means. Here, the said electronic means control the heat exchanger operation 20, the blower fan 21, extraction fan 8 and the cited drive means of the means of inspection in order to regulate the flow rate and the temperature of the entry fluid, together with the exit flow rate of the fluid and solvent vapour at the various zones of the first, second and third sections 12*a*, 12*b* and 12*c*, in function of the signals received from the said temperature sensors.

Although the invention has been described in relation to specific construction examples, these examples have a merely illustrative character and do not limit the scope of this invention, which is defined in the following claims.

The invention claimed is:

1. A flexographic printer with temperature-controlled sections and vapour extraction of the type comprising:

a frame;

at least one rotating back-pressure cylinder, which is mounted on said frame, with an exterior support surface for a band to be printed, at least one flexographic head comprising:

a cliché-holder that can come into contact with the band to be printed over said back-pressure cylinder; and a print head comprising at least one inking cylinder which supplies ink from a tank to said cliché-holder cylinder;

wherein the components of said flexographic print head can be moved closer to or farther away from said back-pressure cylinder, of which there is at least one;

means of rotating drive for said cylinders, of which there is at least one of each and means for movement drive for said at least one flexographic print head;

means of drying or curing a film of ink deposited on the band to be printed; and a surrounding casings, means of interior division which, in combination with said surrounding casing, delimit at least one first and one second sections; and means of circulating fluid through said first and second sections, of which there are at least two and at least one temperature-controlled fluid, with the first and second sections being sufficiently closed and insulated from each other and producing the cited fluid circulation at a flow rate that is sufficient to provide an atmosphere with a concentration of solvent vapour coming from the ink that is below a preset explosion limit in at least the second section, which contains electrical and/or electronic elements and/or devices that are associated with said means of rotation and movement drives.

2. A printer in accordance with claim 1, wherein said means of fluid circulation at a regulated temperature, comprises means of introducing by impulsion and the means of extraction by suction, with respective impulsion mouths and suction connections, located in differentiated zones inside said surrounding casing.

3. A printer in accordance with claim 1, wherein all the means of drive and the associated electrical and/or electronic elements and/or devices are arranged in the cited second section, of which there is at least one, which is separated and sufficiently insulated from the first section, which houses the cited back-pressure cylinders, cliché-holder and inker, together with said means of drying.

4. A printer in accordance with claim 3, wherein said frame comprises first and second support structures with their respective internal faces facing each other and between which are installed the back-pressure cylinders, cliché-holder and inker, together with the means of drying and respective external faces opposite said facing faces, with the means of division arranged in relation to said first support structure in order to create said first section between the internal facing faces of the first and second support structures and said second section in a zone adjacent to the external face of the first support structured.

5. A printer in accordance with claim 4, wherein said means of division are also arranged in relation to said support structure in order to create a third section in a zone adjacent to the external face of the second support structure, in which the third section contains some of the drive means and/or the associated electrical and/or electronic elements and/or devices, with said second and third sections flanked by the first section (12*a*), which then intermediate.

6. A printer in accordance with claim 5, wherein the drive means include the means of guidance and mechanical transmission also located in said second and third sections and safeguarded from possible impregnation by ink, with said first section and the elements it contains easily accessible for cleaning.

7. A printer in accordance with claim 5, wherein said means of introducing the fluid by impulsion comprises at least one fan connected to a fluid introduction conduit, which is fitted with branches with several impulsion mouths distributed inside said first, second and third sections and because said means of fluid extraction by suction comprises at least one fan connected to an exit conduit with branches with several suction connections distributed inside said first, second and third sections.

8. A printer in accordance with claim 7, wherein said means of division comprises fluid curtains that are blown from impulsion mouths connected to introduction conduit branches and located in relation to said first and second support structures in an upper zone inside the casing and sucked from several suction connections, which are connected to the exit conduit branches and located in relation to said first and second support structures in an lower zone inside the casing.

9. A printer in accordance with claim 8, wherein said means of division comprises at least one of elastic, flexible and/or sliding means to cover the apertures in the first and second support structures by means of which the at least one flexographic print head moves.

10. A printer in accordance with claim 7, wherein at least one of said suction connections are located in a lower section of each of the second and third sections in order to extract solvent vapour coming from the ink, together with the exit fluid.

11. A printer in accordance with claim 10, wherein said means of division comprises at least one elastic, flexible and/or sliding means to cover the apertures in the first and second support structures by means of which the at least one flexographic print head moves.

12. A printer in accordance with claim 7, wherein said means of drying or curing comprises at least one drying box connected by one side to the means of impulsion that blow a previously heated fluid over the printed band and is connected at the other side to at least one branch of the exit conduit connected to said means of suction in order to suck said fluid and solvent vapour coming from the ink.

13. A printer in accordance with claim 12, wherein said means of fluid impulsion comprises a blower fan coupled to a conduit connected to a drying box entry, with said fluid being previously heated by a means of heating.

14. A printer in accordance with claim 13, wherein said means of heating is one of a fuel burner or electric heating element.

15. A printer in accordance with claim 5, wherein said fluid that is introduced at a regulated temperature is heated/cooled a means of heating/cooling.

16. A printer in accordance with claim 15, wherein said means of heating/cooling is a water/air heat exchanger.

17. A printer in accordance with claim 16, further comprising at least one temperature sensor located inside the surrounding casing and electronic means of operational control of said heat exchanger and/or blower fan and/or extraction fan in order to regulate the fluid entry temperature and the exit flow rate of the fluid and solvent vapour in function of a signal received from said temperature sensor.

18. A printer in accordance with claim 17, further comprising a plurality of said temperature sensors, located at various points of the first, second and third sections and the means of inspection in various branches of said entry and/or exit conduits, with said means of inspection driven by their respective drive means, where said electronic means control the heat exchanger and/or the blower fan and/or the extraction fan and/or of the means of inspection to regulate the flow rate and temperature of the entry fluid and the flow rate of the exit fluid and solvent vapour in the various zones of the first, second and third sections in function of the signals received from the temperature sensors.

19. A printer in accordance with claim 1, wherein said circulating fluid is a gas.

20. A printer in accordance with claim 19, wherein said gas fluid is air.

21. A printer in accordance with claim 1 comprising a single, common back-pressure cylinder for various flexographic print heads being the temperature of said unique back-pressure cylinder independently regulated by means of a water cooling device.

22. A printer in accordance with claim 1 comprising a plurality of flexographic print heads, each one being associated with a specific back-pressure cylinder.

* * * * *

UNITED STATES PATENT AND TRADEMARK OFFICE

CERTIFICATE OF CORRECTION

PATENT NO. : 7,114,447 B2
APPLICATION NO. : 10/508345
DATED : October 3, 2006
INVENTOR(S) : Xifra I. Boada et al.

It is certified that error appears in the above-identified patent and that said Letters Patent is hereby corrected as shown below:

Claim 1, at Column 9, line 18, “casings” should read --casing--

Claim 4, at Column 9, line 56, “structured” should read --structure--

Signed and Sealed this

Twenty-third Day of January, 2007

JON W. DUDAS
*Director of the United States Patent and Trademark Office*